US005813722A

United States Patent [19]

Smith

[11] Patent Number: 5,813,722

[45] Date of Patent: Sep. 29, 1998

[54] STACKABLE CHAIR

[75] Inventor: Stephen Trevor Smith, Richmond, Australia

[73] Assignee: Hartman Leisure Australia Pty. Ltd., Australia

[21] Appl. No.: 714,147

[22] PCT Filed: Mar. 17, 1995

[86] PCT No.: PCT/AU95/00148

§ 371 Date: Nov. 13, 1996

§ 102(e) Date: Nov. 13, 1996

[87] PCT Pub. No.: WO95/25453

PCT Pub. Date: Sep. 28, 1995

[30] Foreign Application Priority Data

Mar. 18, 1994 [AU] Australia ..... PM4586

[51] Int. Cl.[6] ..... A47C 3/04

[52] U.S. Cl. ..... 297/239; 297/440.22; 297/451.12

[58] Field of Search ..... 297/239, 440.22, 297/232, 451.12, 451.11, 445.1, 447.1, 447.2, 447.3, 446.1, DIG. 2, 440.1, 452.24

[56] References Cited

U.S. PATENT DOCUMENTS

| | | | |
|---|---|---|---|
| 1,911,224 | 5/1933 | Dellert . | |
| 2,055,340 | 9/1936 | Dellert . | |
| 2,642,118 | 6/1953 | Lamb | 297/451.12 X |
| 2,936,826 | 5/1960 | Reineman . | |
| 3,285,660 | 11/1966 | Beckman et al. . | |
| 3,459,449 | 8/1969 | Klausen | 297/451.11 X |
| 3,574,400 | 4/1971 | Day . | |
| 3,971,587 | 7/1976 | Curtis et al. | 297/445.1 X |
| 4,305,616 | 12/1981 | Martinez | 297/440.15 |

FOREIGN PATENT DOCUMENTS

| | | | |
|---|---|---|---|
| 245783 | 6/1963 | Australia . | |
| 1310540 | 10/1962 | France | 297/239 |
| 2218732 | 9/1974 | France | A47C 3/04 |
| 521579 | 5/1940 | United Kingdom . | |

OTHER PUBLICATIONS

Undated advertisement of molded stackable chair.

*Primary Examiner*—Milton Nelson, Jr.
*Attorney, Agent, or Firm*—Sheridan Ross PC

[57] ABSTRACT

An article of furniture adapted for nestwise stacking engagement with a substantially identical article of furniture wherein the article of furniture comprises a body portion and a removable seat portion, the body portion having attached thereto at least one front leg and at least one rear leg wherein at least one of the front or rear legs are adapted to pass through the seat cavity of the body created by the removal of the seat portion and thereby facilitate the nestwise stacking of a plurality of the articles of furniture.

4 Claims, 5 Drawing Sheets

STACKABLE CHAIR

FIELD OF THE INVENTION

This invention relates to stackable chairs and in particular to an improved structural design for such chairs which provides an enhanced freedom of the shape and configuration of stackable chairs not currently available due to the strict structural limitations imposed by the design of currently available stackable chairs.

BACKGROUND OF INVENTION

Chairs are very bulky items of everyday furniture requiring considerable space and volume. When in immediate use, the space occupied by a chair is justified by the occupant. However, when a chair or a number of chairs are vacated the space occupied by these empty items of furniture is considerable and, unlike a table, a chair has a particularly dedicated function and is unlikely to be used for another purpose. Accordingly, the idea of providing chairs which can be stacked one on top of the other when not in use has proved a popular design characteristic and resulted in an abundance of designs relating to stackable chairs.

Since the 1970s when injection moulding techniques have improved and the cost of plastic resin has dropped, an ever increasing range of moulded outdoor and indoor furniture has been developed. The advantages of stackable furniture and in particular stackable chairs has been exploited and an extensive range of stackable furniture has been developed utilizing full resin one shot injection moulding techniques where the chairs are produced in a single moulding operation. The technique of one shot injection moulding or "monobloc" provides a very economic method of manufacture and is largely responsible for the ready availability and low cost of the current stackable chairs currently on the market.

In addition to the space advantages and savings experienced by the end users of stackable chairs a further major advantage of stackable chairs is the low cost of freight involved in transporting quantities of stackable chairs from the manufacturer to the middle users where a quantity of stacked chairs can be packaged into a space not greatly increased over the space required by an individual chair.

However, the current design of strict monobloc stackable chairs and the rigid adherence to one shot construction by manufacturers has placed a number of significant design limitations on current stackable chairs. In particular, the rear legs of stackable chairs must pass over the seat portion and slid through a large opening in the back part of the chair. Although numerous creative designs have been used, the end result of this particular design limitation where the rear legs must straddle the seat has rendered a commonality in the shape of stackable chairs which is universally recognized as stackable "cheap" chairs.

SUMMARY OF THE INVENTION

One object of this invention is to remove some of the above detailed design limitations currently found in stackable furniture and thereby provide stackable furniture capable of adopting a broad range of design configurations not currently available with strict monobloc construction.

Accordingly the invention provides in one aspect an article of furniture adapted for nestwise stacking engagement with a substantially identical article of furniture wherein said article of furniture comprises a body portion and a removable seat portion, said body portion having a seat cavity and further incorporating at least one integral front leg and at least one integral rear leg wherein at least one of said front or rear legs are adapted to pass through the seat cavity of an adjacent body created by the removal of the seat portion of said adjacent body and thereby facilitate the nestwise stacking of a plurality of said articles of furniture wherein said body portion is formed of a single monobloc construction.

The article of furniture may have two front legs and two rear legs with the rear legs adapted to fit through the seat cavity of said body and the front legs adapted to fit outside and abutting the body of said article of furniture.

The seat insert may be substantially planar and supported by the rim of the seat cavity of said article of furniture or the body of said article may be provided with one or a plurality of supporting members traversing said seat cavity in such a manner to allow the insertion of the rear legs of a consecutive number of articles stacked thereon.

The article of furniture is preferably a chair, although other furniture items, for example couches, lounges, footrests and stools are incorporated within the scope of the present invention. The chair embodiment of the invention may be solid backed or sided and most preferably adopts a shell shape.

The body of said chair may be injection moulded as a monobloc with the seat insert provided as a separate article of manufacture.

The invention shall be described in greater detail by reference to the following figures.

DETAILED DESCRIPTION OF THE INVENTION

Figure 1:
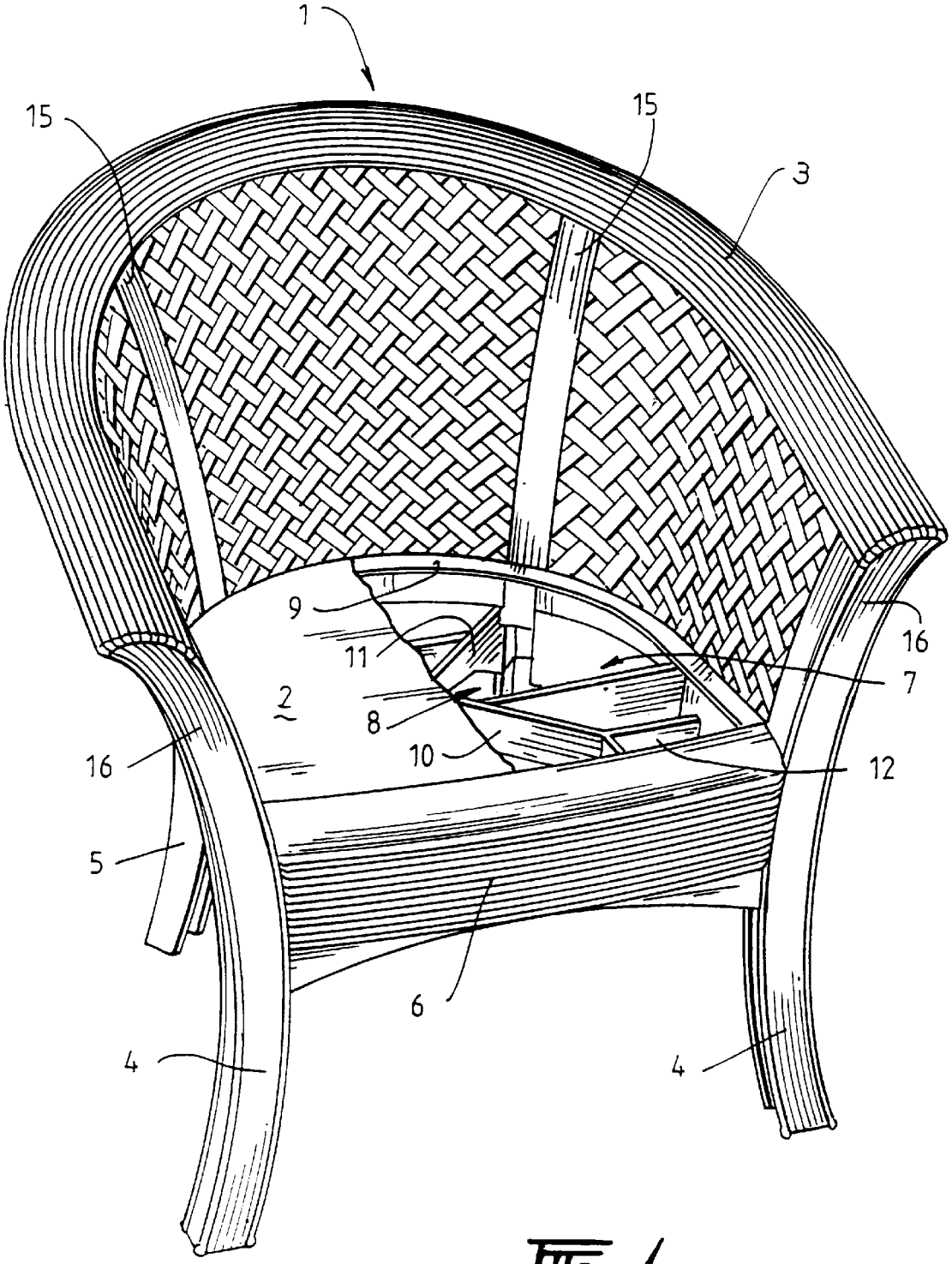
FIG. 1 shows a perspective partially cut-away view of a particularly preferred embodiment of the invention.

Referring first to FIG. 1 the stackable chair conforms to the shape of a shell backed chair having a "solid" webbing or ratten weave insert at the sides and rear. The chair comprises two parts; a body portion 1 and a seat portion 2. The body 1 is capable of injection moulding production in one piece, or monobloc construction. The seat portion is made as an insert (only partially shown) and can be manufactured according to any selected technique. The body 1 of the chair is formed to comprise unitary back and sides 3 which are formed integrally with the front legs 4 and rear legs 5. The front legs 4 can be seen to project up at 16 into the arm of the chair and to provide support for the leading edge of the side insert. Similarly the rear legs 5 project up into the back of the chair at 15. The chair body is supported by a rail 6 which extends around the body connecting the four legs and holding the body in a rigid shape. The seat cavity 7 is traversed by a plurality of supporting members 8 which are adapted to provide a solid support for the seat portion 2. The seat portion 2 is adapted for housing in the seat cavity 7 formed in the body and to be readily removable or interchangeable. The seat portion 2 is supported at the rim of the body 9 and by the supporting members 8 so as to form a snug engagement with the body whilst being readily removable. The supporting rim 9 is positioned vertically to substantially align with the supporting rail 6 and provide a continuous rebate around the seat cavity 7.

Figure 2:
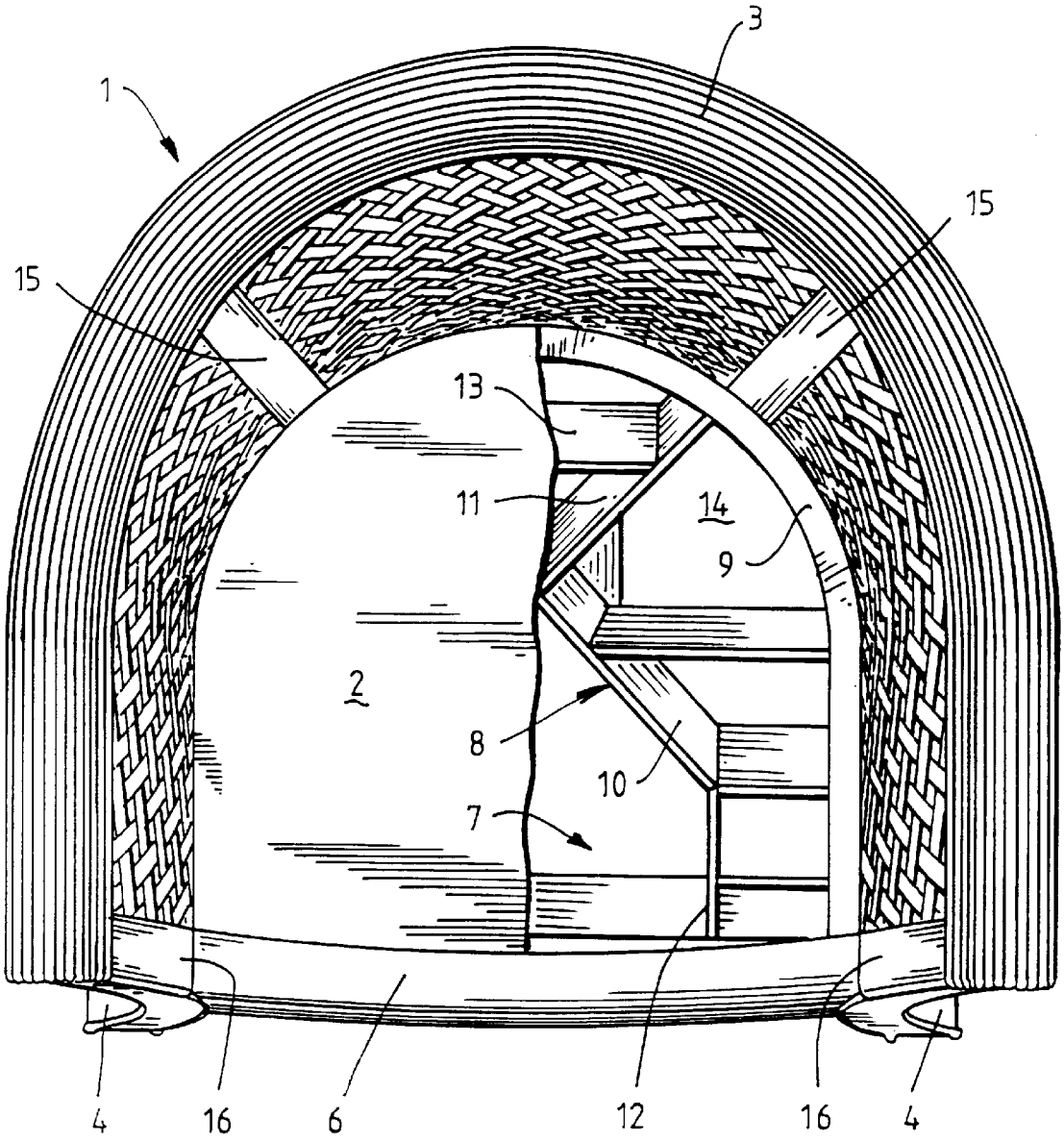
FIG. 2 shows a plan view, again with a partial cut-away view.

Referring to FIG. 2 the supporting members 8 can be seen to comprise two principle cross beams 10 and 11 which substantially traverse the whole of the seat cavity 7 giving support to the seat insert 2. The cross beams attach directly to the rear of the body at the supporting rail 6 and via box sections 12 at the front. The box sections are incorporated into the support members to minimize the exposure of moulding joint to the outside of the front legs 4 thereby reducing the size of the exposed witness. A rear cross beam 13 assists in providing additional surface support to the seat insert as well as providing lateral rigidity to the rear of the chair. The supporting members are specifically positioned to allow the passage of the rear legs of the chair stacked on top to pass through the seat cavity 7 without interference with any of the supporting members. The rear legs of a stacked chair are adapted to pass through the area 14 and thereby clear the underlying chair and stack in a nestwise manner neatly one on top of another. In the particular embodiment disclosed herein the support members are angled in a forward orientation to facilitate the moulding of the body in a single mould action so as to provide a body shape capable of monobloc construction.

Figure 3:
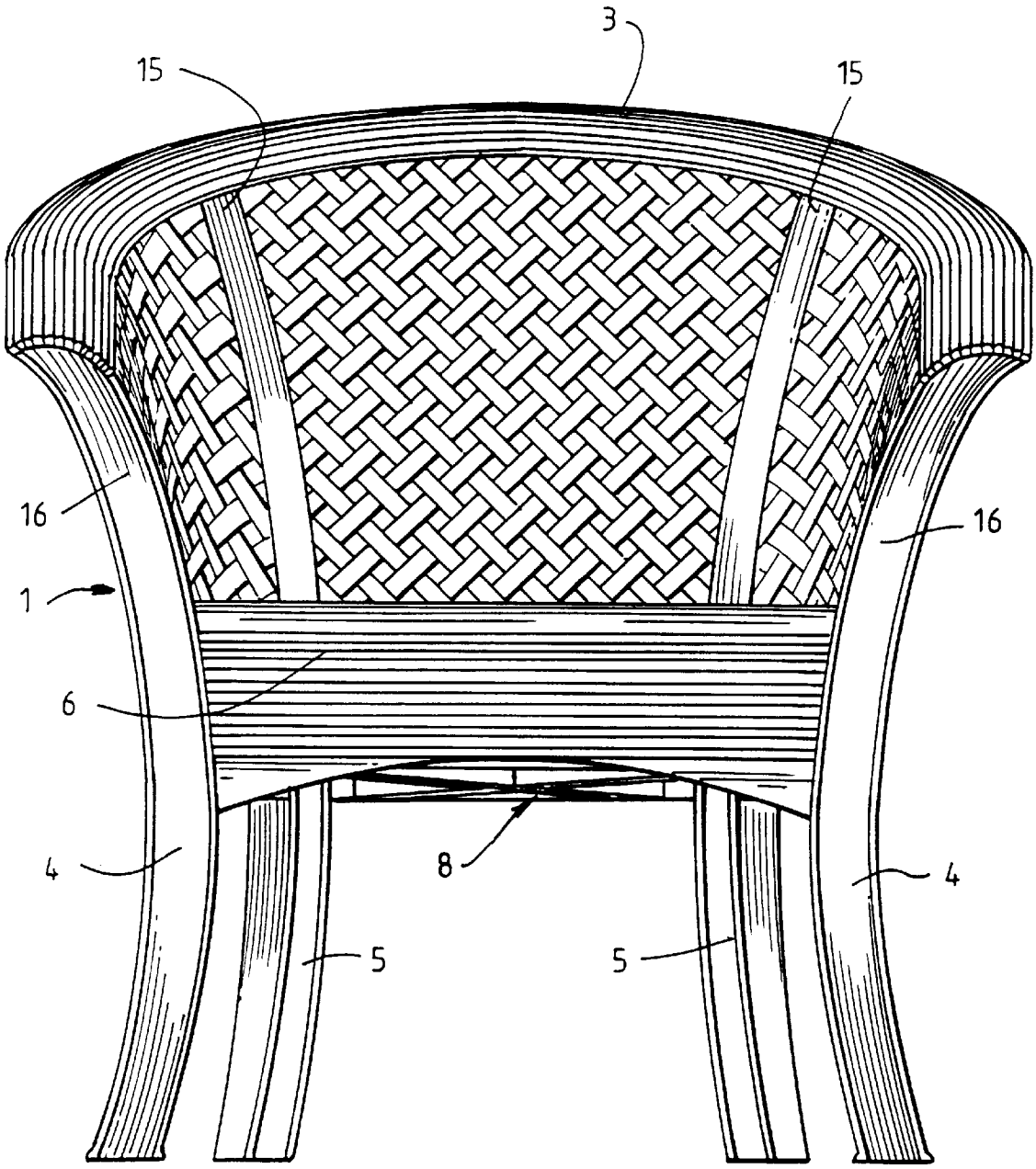
FIG. 3 shows a front view of a chair.

Referring to FIG. 3 the chair can be seen to comprise a one piece body 1 with rear legs 5 formed in line with a back supporting member 15 to provide rigidity to the chair. The rear legs 5 are spaced closer together than the front legs 4 in order to allow the rear legs to pass through the seat cavity 7. The front legs 4 are formed in line with the arm supports 16 in a similar manner to the rear legs.

Figure 4:
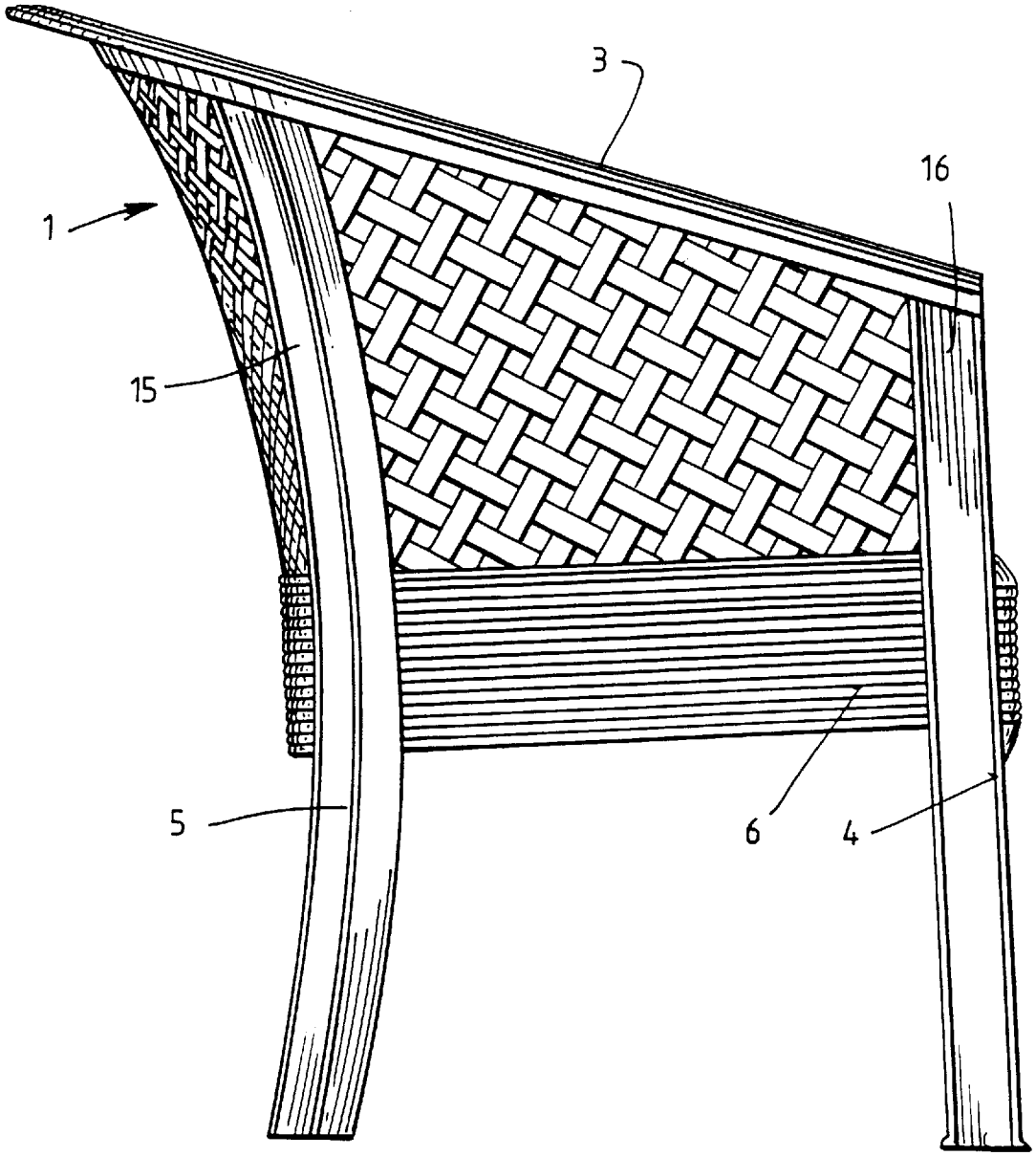
FIG. 4 shows a side view of a chair.

FIG. 4 details a side view of the chair showing the rearward inclination of the back supporting members 15. The arm 3 is in the form of a shell and is moulded integrally with the body 1.

Figure 5:
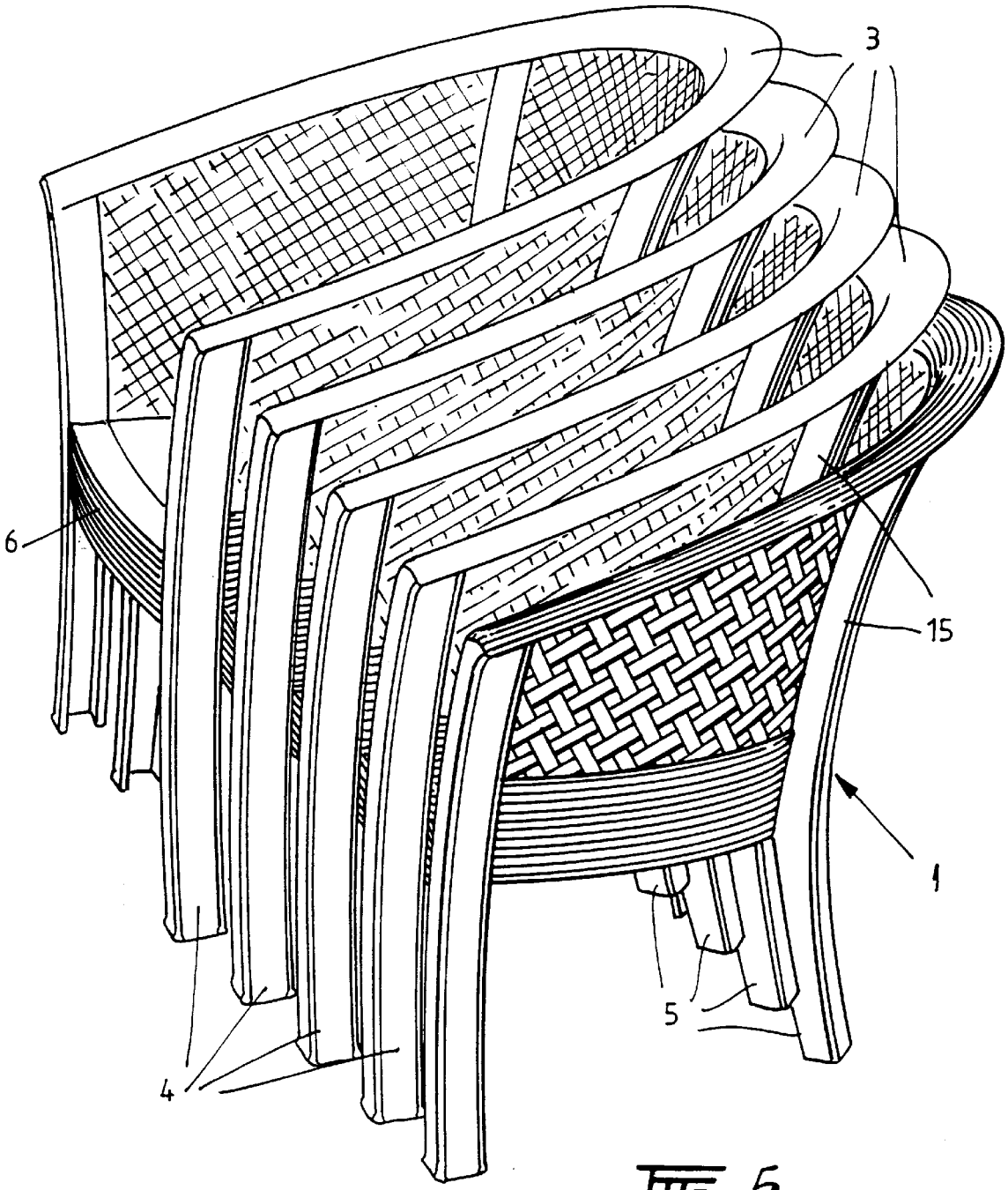
FIG. 5 shows a nestwise stack of chairs.

Referring to FIG. 5 the manner of stacking of a plurality of chairs is detailed where consecutive chairs retain a substantial alignment as the chairs are stacked together.

In use the chairs are gathered together and the seat inserts 2 are all removed. The bodies are then stacked together in groups of a convenient size depending on the type of storage or transport required. For commercial transport of large quantities of chairs a dedicated pallet would be designed to hold the stacked chairs. A stack of about 20 chairs shall provide a manageable package and also accommodate the 20 seat inserts within the top chair. In this manner a plurality of chairs can be stacked together and shipped or simply stored whilst consuming the minimum space.

The provision of a removable seat insert in a one piece moulded chair, thereby allowing the rear legs to pass through the seat area removes a very significant design limitation which has restricted the shape and configuration of virtually all stackable monobloc chairs. The removal of this design limitation provides for a very wide range of different shapes and structures which may be applied to stackable chairs. The only additional manufacturing requirement is for the separate step of providing the seat insert. The manufacture of the seat insert as a separate item allows the variations of possible seat types to be fully explored. For example upholstered or ratten weave seat inserts can be combined with different types of chair.

Accordingly, although the invention cannot be manufactured according to strict monobloc techniques, as at least two moulds are required, the options provided allow for a far greater variation of chair design than is currently available with the current monobloc moulding techniques.

The embodiment of a shell shaped chair is of course only one particularly preferred embodiment and numerous developments and applications of the above construction are covered by the spirit of the invention.

What is claimed is:

1. A plurality of stackable chairs having a first chair adapted for vertical nest-wise stacking engagement with at least another second substantially identical chair of said plurality of stackable chairs, each of said first and second chairs comprising:

a body portion having an open seat cavity; said body portion also having at least one rear leg; said open seat cavity being bounded by a support perimeter comprising a front, a back, and first and second sides;

said body portion further comprising at least one support member having opposite ends secured to and traversing said support perimeter from at least one of said sides to at least one of said front and back, said support member having a central section between said ends, said central section being spaced from said sides and said front and said back to define at least one open leg cavity within said open seat cavity;

said body portion being formed integrally via injection molding; and a seat portion normally on said support perimeter, said seat portion being removable from said support perimeter for exposing said open seat cavity and said at least one support member when said removable seat portion is removed from said support perimeter;

with either said first or second chairs being an upper chair and the other of said first or second chairs being a lower chair below said upper chair, said rear leg of said upper chair being adapted to extend within said support perimeter and without interference from said support member pass through said open leg cavity of said lower article of furniture when said seat portion of said lower chair has been removed from said support perimeter of said lower chair so that said chairs of furniture may be vertically stacked on top of each other.

2. A plurality of stackable chairs according to claim 1, further comprising:

said rear leg joining said support perimeter at a given location; and said at least one support member comprising a plurality of cross beams extending from spaced locations on said support perimeter across said open seat cavity, said spaced locations being spaced from said given location for defining within said open seat cavity said open leg cavity for receiving said rear leg of said upper chair that extends within said support perimeter and passes through said open seat cavity of said lower chair.

3. A plurality of stackable chairs according to claim 1, further comprising:

said body portion having two of said rear legs secured to said back;

said at least one support member comprising at least two of said support members, each of said at least two support members being secured to one of said sides and extending and being secured to said back to define a plurality of said open leg cavities; and each of said rear legs of said upper chair being adapted to extend within said support perimeter and without interference from said at least two support members pass through a respective one of said open leg cavities of said lower chair when said seat portion of said lower chair has been removed from said support perimeter of said lower chair so that said chairs may be vertically stacked on top of each other.

4. A plurality of stackable chairs according to claim 1, further comprising:

a second plurality of said second chairs;

each chair of said second plurality of said second chairs is included in said plurality of stackable chairs; and with said first chair being a lower chair and successive ones of said second chairs being successive upper chairs above said lower chair, said rear legs of said upper chairs being adapted to extend within said support perimeter and without interference from said at least one support member pass through said open leg cavity of said lower chair when said seat portion of said lower chair has been removed from said support perimeter of said lower chair so that said lower chair and said second plurality of second chairs may be vertically stacked on top of each other.

* * * * *